United States Patent [19]

Fischer

[11] 4,000,691

[45] Jan. 4, 1977

[54] ROTARY PRINTING PRESS WITH IMPROVED INKING SYSTEM

[75] Inventor: Hermann Fischer, Augsburg, Germany

[73] Assignee: Maschinenfabrik Augsburg-Nurnberg Aktiengesellschaft (M.A.N.), Augsburg, Germany

[22] Filed: Nov. 14, 1975

[21] Appl. No.: 631,909

Related U.S. Application Data

[63] Continuation of Ser. No. 441,747, Feb. 12, 1974, abandoned.

[30] Foreign Application Priority Data

Feb. 28, 1974 Germany ..... 2309850

[52] U.S. Cl. ..... 101/136; 101/177; 101/183; 101/207; 101/232; 101/350; 101/363

[51] Int. Cl.[2] ..... B41F 31/00; B41F 5/16

[58] Field of Search ..... 101/349, 350, 248, 148, 101/351, 180, 181, 216, 217, , 229, 219, 220, 183, 206, 207, 208, 210, 228, 177, 136, 363, 232, 136, 137, 138, 141

[56] References Cited

UNITED STATES PATENTS

| | | | |
|---|---|---|---|
| 1,756,308 | 4/1930 | Schmidt | 101/349 |
| 1,840,343 | 1/1932 | Wood | 101/310 |
| 2,103,254 | 12/1937 | Goedike | 101/148 |
| 2,430,965 | 11/1947 | Taylor | 101/350 |
| 2,821,131 | 1/1958 | Spiller et al. | 101/181 |
| 2,834,290 | 5/1958 | Meyer | 101/350 |
| 2,942,543 | 6/1960 | McIluain et al. | 101/181 |
| 3,026,795 | 3/1962 | Dietrich | 101/148 |
| 3,038,405 | 6/1962 | Wojciechowski et al. | 101/148 |
| 3,094,065 | 6/1963 | Roberts | 101/148 |
| 3,096,710 | 7/1963 | Wojciechowski et al. | 101/148 |
| 3,098,437 | 7/1963 | Tyma, Jr. et al. | 101/350 |
| 3,102,471 | 9/1963 | Auer et al. | 101/181 |
| 3,106,154 | 10/1963 | Saul | 101/148 |
| 3,168,037 | 2/1965 | Dahlgren | 101/148 |
| 3,196,788 | 7/1965 | Knowles | 101/217 |
| 3,264,983 | 8/1966 | Lewis et al. | 101/181 |
| 3,274,930 | 9/1966 | Nagel | 101/180 |
| 3,280,737 | 10/1966 | Huck | 101/180 X |
| 3,283,712 | 11/1966 | Chambon | 101/350 |
| 3,285,169 | 11/1966 | Hartwig | 101/350 X;207 |
| 3,384,011 | 5/1968 | Bolza-Schunemann | 101/229 X |
| 3,440,900 | 4/1969 | Neal | 101/181 X |
| 3,467,008 | 9/1969 | Domotor | 101/148 X |
| 3,587,460 | 6/1971 | Chambon | 101/148 |
| 3,673,959 | 7/1972 | Jeruit | 101/148 |
| 3,785,285 | 1/1974 | Chambon | 101/148 |

*Primary Examiner*—Edgar S. Burr
*Assistant Examiner*—Paul J. Hirsch
*Attorney, Agent, or Firm*—Flynn & Frishauf

[57] ABSTRACT

The circumferential speed of driven ink application rollers is controlled to be less than the circumferential speed of the plate cylinders to which the ink application rollers supply ink and with which it is in friction-transmission connection. Preferably, the speed difference is adjustable, and so arranged that the circumferential speed of the driven ink application roller is less than the plate cylinder, any other driven rollers in the ink train being intermediate between the slowest ink application roller and the plate cylinder and, further, that, in case of sequentially arranged plate cylinders, the relative speeds of the ink application rollers associated with sequential plate cylinders become less, in the direction of web transport, to place frictional loading on the plate cylinders and thus provide for positive engagement of all drive gearing to overcome play therein and improve registration of sequentially printed data.

9 Claims, 5 Drawing Figures

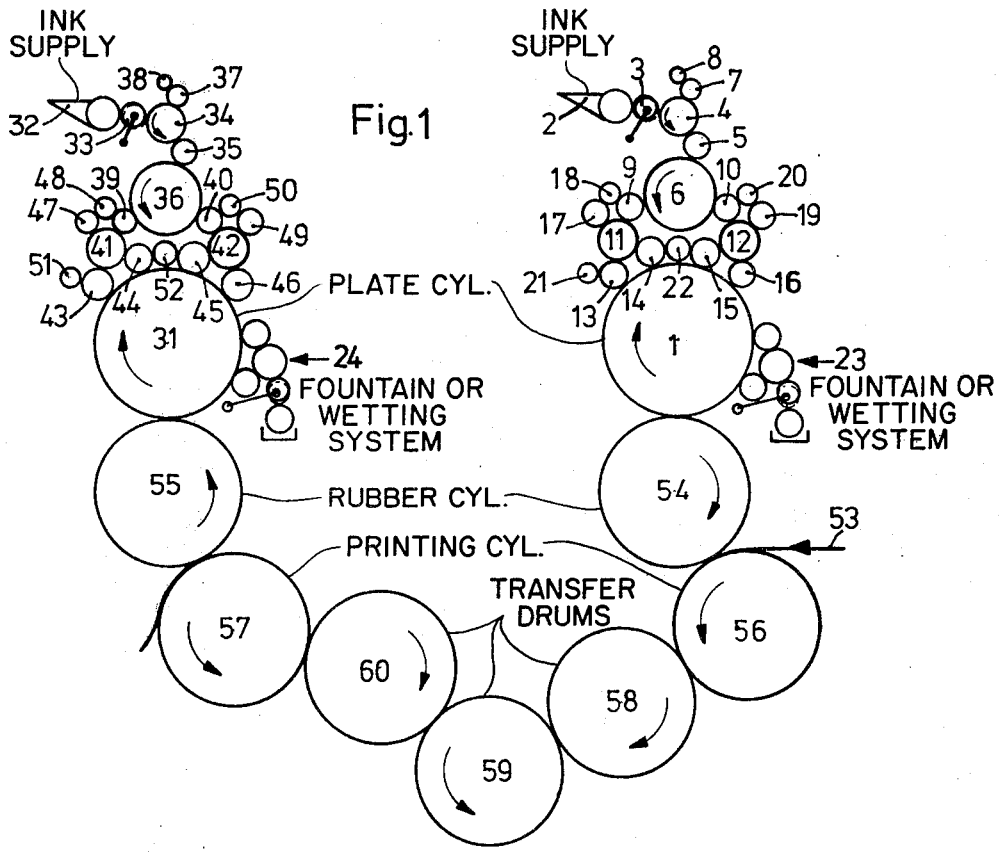
Fig.1
Fig.2
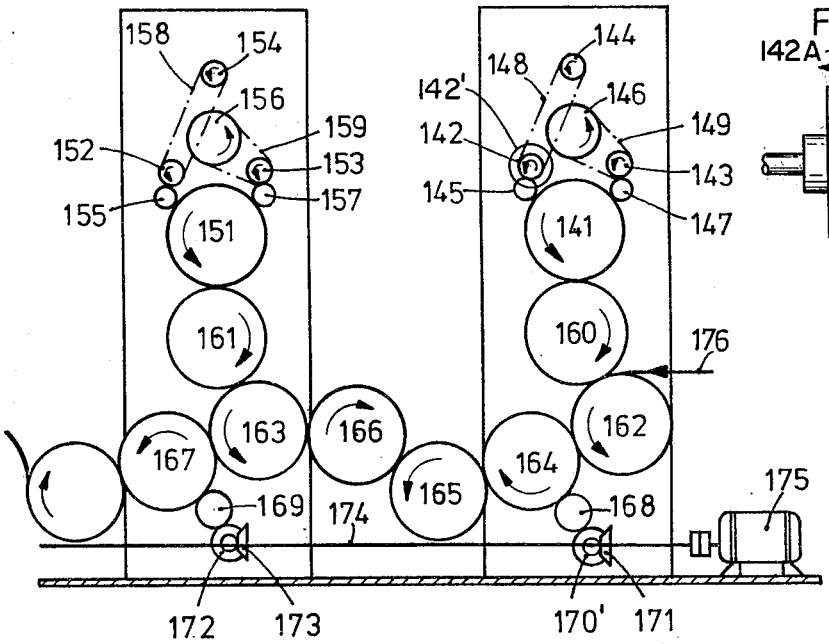
Fig.2a
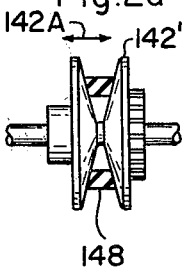

ROTARY PRINTING PRESS WITH IMPROVED INKING SYSTEM

This is a continuation of application Ser. No. 441,747, filed Feb. 12, 1974, now abandoned.

The present invention relates to rotary printing presses, and more particularly to rotary offset-type printing presses which are driven from one main drive source, and which have a plurality of plate cylinders, serially arranged to have web material (continuous or in sheet form) passing therethrough.

Rotary offset printing presses having serially arranged printing systems are frequently driven from a single drive source. The printing cylinders are usually driven by separate gears. The associated inking systems are also driven by gears, in turn connected to the main drive source. This arrangement is customary both in raised letter printing presses, as well as in offset printing presses, both for continuous webs, or for separately fed sheets. The gear ratios of the various gears driving the printing plates, the rubber cylinders, or the printing cylinders, as well as the inking systems, are usually so arranged that all cylinders rotate in synchronism, that is, the circumferential speed of the plate cylinders, rubber cylinders or printing cylinders correspond to the circumferential speed of the drive gears and, in turn, to the circumferential speed of the various driven inking rollers. Play between the gears driving the various cylinders is unavoidable in such printing systems. Thus, relative movement between the cylinders within a composite, or tandem, or serially arranged printing press is usually present. As a result, registration of the printed material passing through various printing cylinders, for example to be printed with various colors, canot always be ensured, resulting in doubling, or over-printing. This mis-registration may be due to the aforementioned play, as well as to oscillations resulting in transfer of the engagement flanks of the drive gears from the leading to the trailing side during relative rotation of the gearing. Further, the shaft stubs to which the gears are connected may slightly bend, further preventing exact synchronism of rotation of the cylinders with respect to each other.

Variations in application of ink to the printing presses, due to changing in the relative engagement of the flanks of the gears could be overcome by using a different type of drive; for example (see German Pat. No. 2,260,147), it has been proposed to substitute sprocket chains, or gear chains for rotary spur gears, driving all printing systems, serially, from the first to the last printing system in a row by such a sprocket chain, or gear chain arrangement. Use of such a drive avoids the transfer of power transmission between the leading and trailing flank of gears; the increased cost, and the necessity to provide additional drive elements, guide rollers and the like in such an arrangement is, however, undesirable.

It is an object of the present invention to provide a printing press, and more particularly a printing press with a plurality of serially arranged printing cylinders which is so arranged that over-printing, or mis-registration, or defective inking is avoided, while the existing components and drive elements, including the drive train of the press are utilized.

SUBJECT MATTER OF THE PRESENT INVENTION

Briefly, the circumferential speed of one, or more of the ink application rollers, for example forming ink storing friction cylinders, is so set that a braking effect is obtained, which is transferred to the main drive. The circumferential speed of these ink application rollers, driven from the main drive, is thus selected to be less than of the plate cylinder, or of a further ink application roller adjacent the plate cylinder.

The film of ink between the cylinders and the inking train is pulled due to the different circumferential speeds of the various ink application rollers. This spreading, or pulling of the ink requires forces which are derived from the main drive. These forces have a braking effect on the main drive, and thus affect the play between gearing, eliminating circumferential oscillations of the various printing cylinders. Simultaneously, the spreading of the ink due to the customary axial movement of the application rollers is improved with respect to previously used inking systems, to result in a film of ink which is thinner, but of more uniform thickness. The inking system may, therefore, be constructed to have a lesser number of rollers, thus decreasing the overall costs of the printing press.

In a discussion that follows, it is assumed that the viscosity of the ink to be used in the various inking systems is approximately similar; thus, the circumferential speeds of the inking rollers can easily be matched with respect to each other by using essentially similar ratios of lesser speeds for the inking rollers than for the printing cylinders. If the differences in viscosity of the inks used by various sequentially arranged inking systems, and applied to sequentially arranged printing systems differ substantially from each other, however, then the circumferential speeds of the inking system in which ink of particularly low viscosity is used must be selected to be slightly higher than otherwise, so that the braking effect in this particular printing system, and inking system, does not result in excessive braking with respect to the overall printing press, and particularly with respect to further printing systems downstream (in the direction of travel of the web) of the printing system operating with a high viscosity ink. The various circumferential speeds, therefore, should be selected so that the retarding or drag effect applied to the printing cylinders, serially or sequentially arranged, is approximately the same for each printing system.

The invention will be described by way of example with reference to the accompanying drawings, wherein:

FIG. 1 is a highly schematic representation of the various printing and inking rollers for a rotary press to print separate sheets, showing two serially arranged three-cylinder printing systems, together with the inking systems, in a schematic side view;

FIG. 2 is a highly schematic view of the drive system for the main printing cylinders, transfer cylinders and for the inking systems of the press in accordance with FIG. 1;

Figure 3:
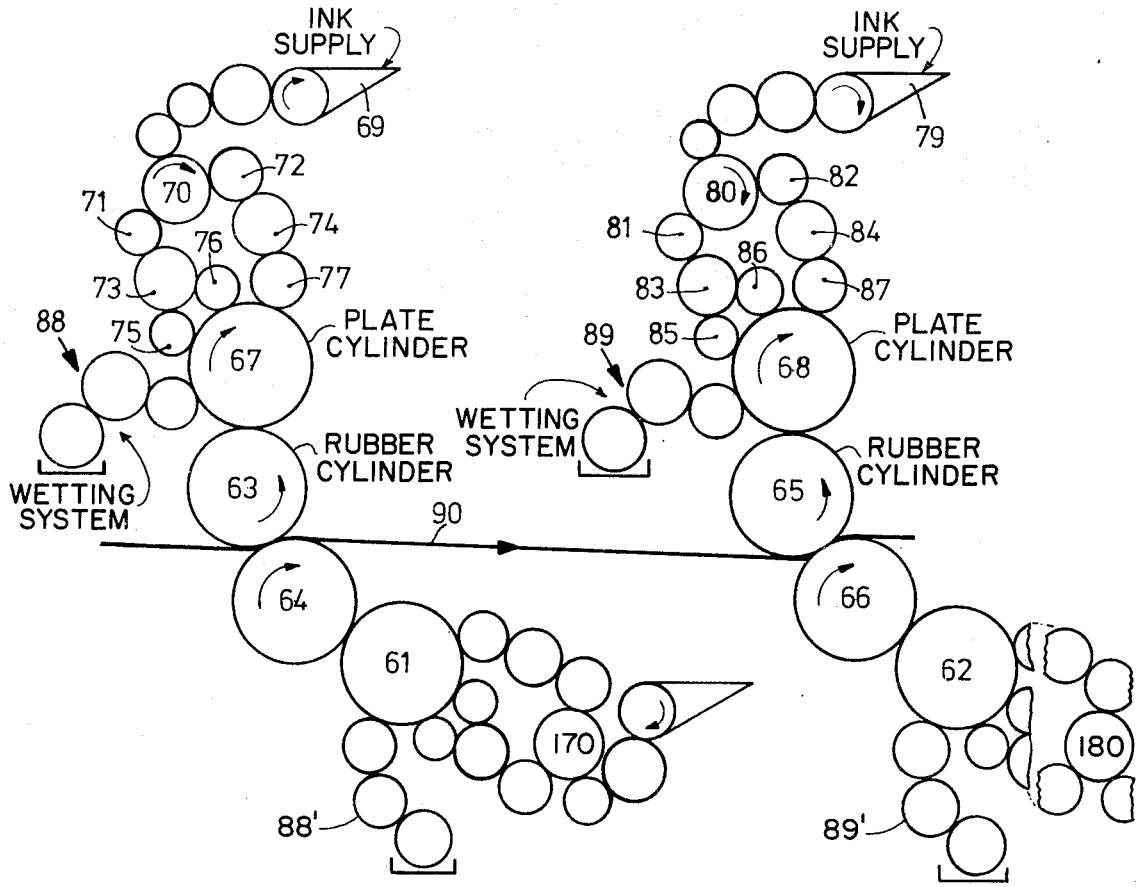
Figure 4:
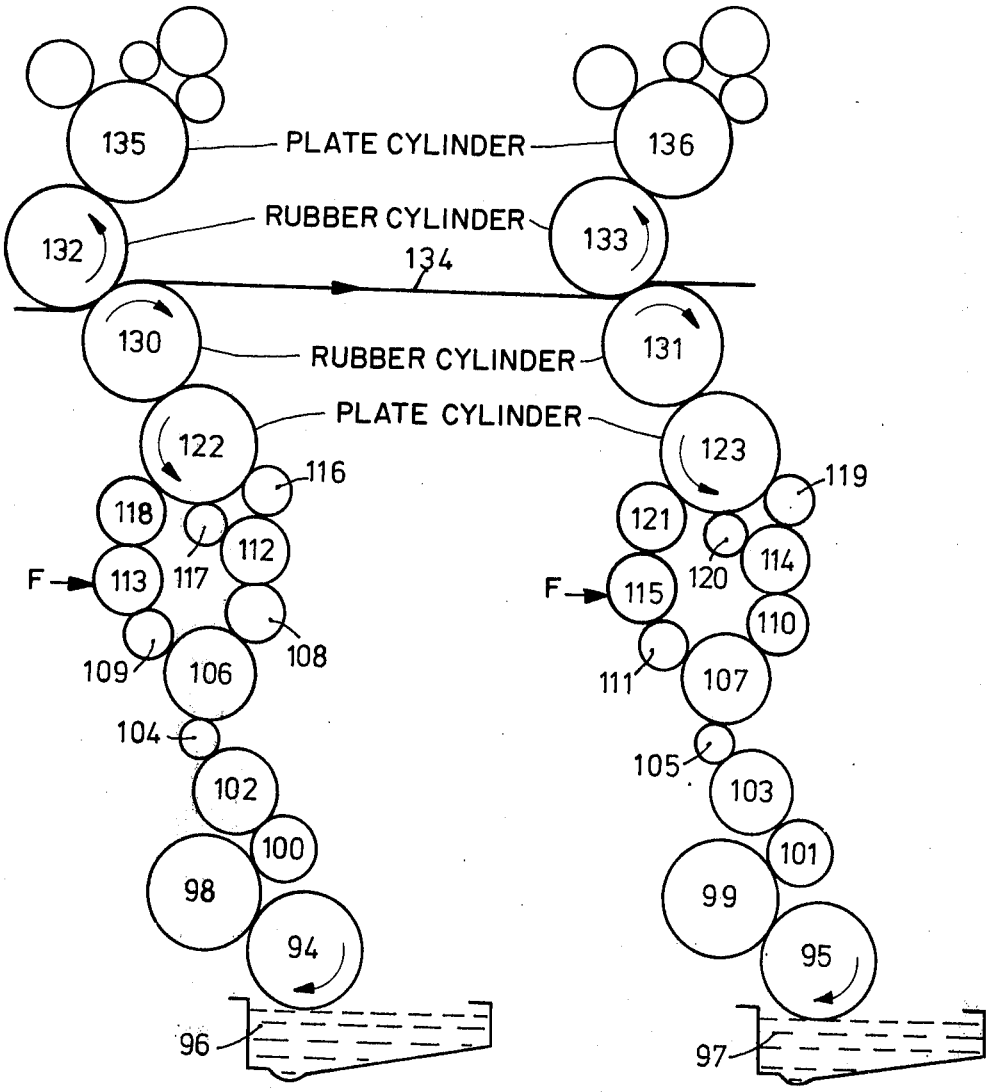

FIG. 2*a* is a fragmentary side view showing, in schematic representation, a variable speed drive;

FIG. 3 is a schematic view similar to FIG. 1, of an offset printing system for double-sided printing on a continuous web; and FIG. 4 is a schematic representation arranged similarly to FIG. 1 for printing on a web, with ink supply beneath the web to be printed.

General discussion, with reference to FIGS. 1, 2 and 2*a*: The right-hand printing system (FIG. 1) has a plate cylinder 1, to which ink is supplied from an ink supply 2, transmitted over an intermittently operating transfer roller 3 to a rubbing cylinder 4, the ink being transmitted over intermediate roller 5 to a rubbing cylinder 6, where the ink is separated into two paths, to be applied to plate cylinder 1. For better distribution on the rubbing cylinder 4, a pair of idler rollers 7, 8 can be used in engagement therewith, in order to increase the number of nips, in which the ink is being treated. The cylinders 4, 6 may reciprocate axially for better uniformity of ink distribution along the circumference thereof.

Transfer rollers 9, 10 engage the roller 6. The transfer rollers 9, 10, in turn, are in contact with friction rollers 11, 12. Ink is transmitted over further transfer rollers 13, 14, 15, 16, respectively, to the plate cylinder 1. Similarly, further idlers, in the form of rollers 17, 18 and 19, 20, can be associated with the friction rollers 11, 12, the rollers 18, 20 engaging the transfer rollers 9, 10. If particularly high requirements are placed on uniformity in ink, similar idlers 21, 22, respectively, can be associated with the rollers 13, 14 and 15, respectively.

The friction cylinders, as customary, have a metallic surface; the transfer and the various other rollers have a rubber surface.

The second printing and inking system, at the left side of FIG. 1, is similar to that of the first printing system at the right side thereof. Plate cylinder 31 is supplied with ink from an ink supply 32, from which an intermittent roller 33 transfer ink to a first friction, or application roller 34, which is connected over an intermediate roller 35 to a second friction roller 36. Ink is separated into two paths from roller 36, for application to the plate cylinder 31. The first friction or application cylinder 34 has two idler rollers 37, 38 associated therewith for better uniformity of distribution of ink. The friction rollers 34, 36 move axially. Friction roller 36 is associated with transfer rollers 39, 40, engaging friction rollers 41, 42. Ink is applied over rollers 43, 44, 45, 46 to the plate cylinder 31. Idler rollers 17, 18, 19, 20, respectively, of the right inking system of FIG. 1 have corresponding rollers at the left, that is, rollers 41, 42 and 39, 40, respectively; likewise, idler rollers 47, 48, 49, 50 are provided, as well as a idler roller 51 for application roller 43. A further idler roller 52 may be located between the application rollers 44, 45 if high requirements in uniformly of ink are placed on the press, thereby increasing the number of distribution nips for the ink.

The sheets 53 are applied to the rubber cylinder 54 and printing cylinder 56, transferred by means of transfer drums 58, 59, 60 to a second printing system including rubber cylinder 55 and back-up cylinder 57. Fountains or wetting systems are associated with the plate cylinders 1, 31, and schematically shown at 23, 24, respectively. These fountains or wetting systems may be any known type, standard in the art.

The drive system (FIG. 2) has a main drive motor 175, driving a main drive shaft 174. The plate cylinder 1 (FIG. 1) of the right printing system has connected thereto a drive gear 141 (shown as a circle, for simplicity of illustration). At least some of the rollers of the ink train are positively driven. Roller 11 is driven by a drive gear 142, and roller 12 is driven by a drive gear 143. The shaft of the application and friction roller 6 has applied thereto a pair of conical drive wheels 146; the shaft of the application cylinder 4 likewise has conical drive wheels 144 secured thereto. Gears 141 and 43, respectively, are driven from the plate cylinder gear 141 over intermediate pinions 145, 147.

The left printing system (FIG. 1) has a main drive gear 151 for the plate cylinder 31, gears 152 for the application roller 41 and gears 153 for the application roller 42. The application and friction roller 36 is driven by a conical drive disk system 156; the application and friction roller 34 is driven by conical drive disk 154. Connecting pinions 155, 157 connect the gears 152, 153, respectively, with the main drive gear 151.

The remaining rollers illustrated in FIG. 1 and associated with the ink system are carried along by circumferential friction of the rollers themselves, and are not specifically positively driven.

In accordance with the present invention, and contrary to prior practice, the drive speeds, that is, the circumferential speed of the respective rollers of the friction rollers with respect to the drive speed of the plate, rubber or printing cylinders is selected such that the speed of the roller 4 adjacent the ink fountain is held to be below the speed of the next friction roller 6, in the direction of ink transfer. The speed difference may be quite substantial, that is, up to about 10% less than the circumferential speed of the plate cylinder 1. Similar relationships are established at the left printing system (FIG. 1) and the speed of the ink friction roller 34 is held to be less, by about 10% than the speed of the plate cylinder 1. In order to provide for speed adjustment, and to decrease the circumferential speed of the ink application roller 4, 34, respectively, with respect to the associated printing plate cylinder 1, 31, respectively, drive gear 142 has a pair of opposed, relatively movable conical drive disks 142' secured thereto (see FIG. 2*a*), movable in the direction of arrow 142A towards and away from each other. Two similar drive disks 144 are secured to the shaft of the friction and ink application roller 4. A V-belt 148 is connected between the conical drive disks 142' and 144. Upon movement of the drive disks 142' towards each other, corresponding movement is transmitted to the drive disks 144 to separate them from each other. Such variable drive speeds are well known. Thus, the speed transmission ratio, and hence the circumferential speed of application cylinder 4 can be continuously variably changed. This arrangement permits fine matching of speeds, and hence of retardation or braking torque being applied to the plate cylinder. The amount of braking torque should preferably be just enough to prevent gear chatter, or play; the speed retardation to effect such braking torque will depend on the viscosity of the ink, and a continuously variable speed drive, as provided, for example, by conical sheaves, permits easy matching of speeds with little structural complexity.

Similarly, a V-belt 149 connects conical sheaves 146 connected to the shaft of the friction cylinder 6 to the drive gear 143, connected to the shaft of roller 12, which gear 143 is constructed similarly to that shown in FIG. 2*a* and likewise supplied with relatively movable conical drive disks or sheaves. The details of such continuously variable speed drives are well known and, therefore, FIG. 2*a* merely shows the arrangement, schematically, without the detailed constructional features, such as means to hold the sheaves in a relatively spaced axial position, springs, release means and the like.

The other printing systems are similarly constructed, as indicated at the left side of FIG. 2, in which a V-belt connects relatively movable conical disks 158 with disks secured to gear 152, and a V-belt 159 connects relatively movable sheaves 156 to similar sheaves connected to gear 153, in order to drive rollers 34 and 36, respectively.

The continuously variable speed drive as illustrated, schematically, for example in FIG. 2*a*, is particularly simple, easy to instal and reliable. Other known drive systems may be used, which permit either infinitely variable speed transmission, or which provide for a retarded speed of the respective rollers 4, 6 with respect to the plate cylinder 1 (and rollers 34, 36 with respect to plate cylinder 31, respectively). The rollers 4, 6 may be driven by well known gear drives. In accordance with the present invention, however, and contrary to prior practice, the gears associated with rollers 4, 6 have such outer diameter, and number of gear teeth that the speed of the rollers 4, 6 is less than that of the associated plate cylinder 1. Combinations of variable speed drives and fixed, reduced speed drives are also possible.

The plate cylinder main gears 141, 151 are driven by gears 160, 161, associated with rubber cylinders 54, 55, and in turn by gears 162, 163 associated with the printing cylinders 56, 57. The gears 162, 163 are connected together by the gearing system formed of gears 164, 165, 166, which gears are connected to the transfer drums 58, 59, 60, respectively. The respective printing systems and inking systems are driven from gears 164, 165, respectively, which, in turn, are driven by intermediate transfer pinions 168, 169 which are in engagement with pinions 170', 172, driven, in turn, by a right angle pinion 171, 173, respectively, connected to the main shaft 174. The sheet to be printed, schematically illustrated at 53 in FIG. 1 follows a path 176 (FIG. 2) and is printed and transferred by the printing cylinders and transfer drums, as known.

The different circumferential speeds will tend to pull the ink film on the respective friction rollers. Pulling, and distribution of the ink film on the friction rollers can be further improved by selecting the speeds of the various driven friction rollers 4, 6 (34, 36, respectively) of the printing system to be different among each other. In a preferred form, the application roller 4 has a lower speed than that of the application friction roller 6. The application friction roller 6, in turn, has a lower speed than that of the plate cylinder 1. Similarly, the circumferential speed of the first (in the direction of ink transfer) friction roller 34 is less than that of the friction roller 36 of the left hand printing system which, in turn, is less than the speed of the plate cylinder 1. Apart from the braking effect within the inking system, the slipping action of the friction rollers with respect to adjacent rollers provides for better distribution of the ink on the rollers.

The retardation effect from the friction application roller 4 to the plate cylinder 1 at the right, or leading printing system (FIG. 1) can be the same as the retardation applied by the roller 34 to plate cylinder 31 at the left, or trailing printing system. The circumferential speeds of the ink storage friction cylinder systems 4, 34 (and including the intermediate rollers 6, 36) of sequential printing systems may be so selected that the braking effect transferred from the inking system by gear 168 on shaft 174 is the same for all printing systems. Better braking effect, and better overall results can be obtained when the circumferential speeds of subsequent printing systems, that is, downstream in the direction of movement of the web to be printed, have circumferential speeds which are so selected that the braking effect increases as the particular printing system becomes more distant from the first printing system — assuming equal viscosity of the ink in all the printing systems. Thus, the relative speeds can be so arranged that the application friction roller 34 of the left-hand system (FIG. 1) operates at a slower speed than that of the similar roller 4 of the right-hand printing system. Likewise, the left-hand intermediate friction roller 36 will operate at a slower speed than that of the roller 6 of the right-hand printing system. The speed of the plate cylinders 1, 31, of course will be identical. If the viscosity of the ink should differ, then the speeds of the various rollers should be so adjusted that the braking effect or retardation torque applied to the cylinders downstream in the path of movement of the web to be printed is greater than that of printing systems upstream. The difference in retardation torque between printing systems, preferably, should be the same.

If the printing systems are driven individually, then the ink storage friction cylinders 4, 6 and 34, 36 of sequential printing systems can be so arranged that their circumferential speeds progressively decrease, so that the braking action in the respective printing systems increases in the direction of the path of the printing web. Individual drive to the inking systems is then accordingly controlled such that the circumferential speed of the left-hand friction rollers 34, 36 is less than that of the similar friction rollers 4, 6, at the first printing system on the right-hand side.

The friction rollers 11, 12 operate at the same, or essentially the same speed as that of the plate cylinders, at the most having a slight speed differential in order to permit adjustment of the amount of ink being transferred, for example as described in German Patent DT-PS No. 1,265,165.

Embodiment of FIG. 3: The basic system is the same, and the essential difference, which has been illustrated schematically, is that the system of FIG. 3 is intended for printing on both sides of a web which is continuous, rather than on sheets. Two sequentially located double-sided printing systems of an offset printing press with the associated inking systems are shown, schematically. The rubber cylinders 63, 64 in the first printing system are followed by rubber cylinders 65, 66 in the second printing system. Rubber cylinder 63 is contacted by plate cylinder 67; rubber cylinder 64 is contacted by plate cylinder 61. Rubber cylinder 66 is contacted by plate cylinder 62 and rubber cylinder 65 is contacted by plate cylinder 68. The first printing system provides ink from an ink supply 69 over three rollers, not specifically shown or described and as well known in the art, to a friction roller 70, then is transferred over transfer rollers 71, 72 to the friction rollers 73, 74, which are contacted by application rollers 75, 76, 77, in order to apply ink to the plate cylinder 67. The friction rollers 73, 74 operate at essentially the same circumferential speed as that of the plate cylinder 67. The friction roller 70, however, in accordance with the present invention, is driven with a reduced speed in order to provide a braking torque due to the speed difference and the viscosity of the ink, and to inhibit change of engagement of drive gears of the main drive. Similarly, the difference in speed prevents peeling of ink between adjacent cylinders or rollers and thus provides for better ink distribution. Plate cylinder 68 of the second printing system has ink applied similarly from an ink supply 79 over three transfer rollers, not further described since well known in the art, and applied to a friction or application roller 80, which is driven. The ink is then transferred to transfer rollers 81, 82, friction rollers 83, 84, and final application rollers 85, 86, 87, applying the ink to the plate cylinder 68. Wetting systems or fountains 88, 89 are shown only schematically. A continuous paper web 90 passes between rubber cylinders 63, 64 and 65, 66. The friction rollers 70, 80 are driven with a speed which is less than that of the plate cylinders 67, 68. To further improve the braking effect over the printing machine which has sequential printing systems, it is preferred to so adjust the circumferential speed of roller 80, similar to roller 34 of FIG. 1, to be less than the speed of roller 70, since it is downstream in the path of travel of the web 90 to be printed. Thus, all printing systems, in the direction of travel of the web, are held under some tension, thus preventing oscillations which may arise in the drive system, and providing for printing by the various systems which is always in register. The printing systems themselves are connected by shafts and gears (not shown) similar to the arrangement of FIG. 2, and the speeds, and differential speeds, can be similarly controlled.

The inking systems and wetting systems for the plate cylinders 61, 62 beneath the web 90 are similar to the system described in connection with plate cylinder 67 and not described in detail. The circumferential speed of the friction application cylinder 170 is less than that of the plate cylinder 61. It is, however, the same as that of the application friction cylinder 70 above the web 90, so that the pull applied between the upper printing systems 63, 67 and the lower printing systems 64, 61 on the web 90 will be identical. The printing system 62, 66 has a friction roller 180 associated therewith, shown only fragmentarily, which has a circumferential speed similar to that of friction roller 80 above web 90. Since it is downstream of friction roller 170, it may operate at a lower speed than the roller 170, if the roller 80 likewise operates at a lower speed than roller 70. The pull on both sides of the paper exerted by rubber cylinders 65, 66 must, of course, be the same.

Wetting systems 88', 89' are associated with plate cylinders 61, 62, respectively.

FIG. 4 illustrates two four-cylinder printing systems, in which the lower ink supply trains are shown in greater detail. Ink is supplied from reservoirs 96, 97 by ink ductors 94, 95, respectively, to an ink roller 98, 99. A transfer roller, each, 100, 101, transfers ink to the first friction or application roller 102, 103, respectively, then over a further transfer roller, each, 104, 105, to a second friction roller 106, 107. Ink is split into two paths at each of the rollers 106, 107, respectively, as described in FIG. 3, and transferred over transfer rollers 108, 109 and 110, 111, respectively, two friction rollers 112, 113 and 114, 115, respectively, to three application rollers 116, 117, 118, and 119, 120, 121, respectively, to be applied to the respective plate cylinder 122, 123. For offset printing, friction roller 113 and the application roller 118, as well as friction roller 115 and the application roller 121, respectively, may be constructed as an ink-accepting wetting system, if the friction roller 113, 115, respectively, is formed with a surface or sheath of copper, to which wetting liquid, such as water, is sprayed, as indicated by the arrows F. The rubber cylinders of the two printing systems are shown at 130, 131. The rubber cylinders of the upper printing systems are indicated at 132, 133. The paper web 134 passes through the nip between rollers 130, 132, and 131, 133, respectively. The plate cylinders of the upper printing systems are shown at 135, 136. In accordance with the present invention, the friction rollers 102 and 105, as well as 103, 107, respectively, are driven with a speed which is less than that of the plate cylinders 122, 123, respectively. Further, the speed of the rollers 103, 107 at the right-hand side of FIG. 4 may be less than the speed of the rollers 102, 106 at the left-hand side, upstream in the path of travel of the web 134. Additionally, and to further increases the braking effect and to improve distribution of ink on the ink film rollers 98, 99, the rollers 98, 99 may be operated at a speed which is less than that of the friction rollers 102, 103, respectively. The circumferential speeds of the ink film rollers 98, 99, as well as of the friction rollers 102, 106; and 103, 107, in the same inking train, may be different from each other. The upper inking systems, in contact with the plate cylinders 135, 136, and not shown in detail, may be the mirror image of those specifically described in connection with FIG. 4; the speeds of the driven friction and application rollers frictionally engaging — indirectly — the rubber cylinders 130, 132 must be the same, as described in detail in connection with the embodiment of FIG. 3. Suitable drive shafts, from a common drive source, drive the various driven rollers, preventing change in engagement at the flanks of drive gears.

The braking or retarding torque applied by sequential inking systems or printing systems, respectively, can be enhanced by selecting the circumferential speeds of friction rollers associated with printing systems downstream - in direction of travel of the web — to be less than that of similarly located rollers upstream.

Various changes and modifications may be made within the scope of the inventive concept. Specific printing systems have been shown, to which the invention may be applied; the invention may, similarly, be applied to other printing systems by suitably selecting the speeds of friction or application rollers in the ink train of the inking system to be less than that of the plate cylinder to which the ink is eventually applied.

I claim:

1. Rotary offset printing press having a drive motor (175) and a plurality of serially - in the direction of feed of the material to be printed - arranged printing systems, each printing system comprising a plate cylinder (1, 31);

gear means (170', 171, 168, 164, 162, 160, 141; 172 173, 169, 167, 163, 161, 151) driven by the motor (175) driving the plate cylinders (1, 31) of the systems;

a wetting system (23, 24);

an inking system including an ink supply (2,3; 32, 33) and an inking roller train having ink transport and application rollers for each system transporting ink from said supply to the plate cylinder including a driven ink supply friction roller (4,34) and ink friction roller drive means (145, 142, 148, 144; 155, 152, 158, 154) positively driving said driven ink friction roller independently of the plate cylinder, at least one driven intermediate friction roller (6, 36) and intermediate friction roller drive means (147,

143, 149, 146; 157, 153, 159, 156) positively driving said at least one driven intermediate friction roller (6, 36), and at least one ink application roller (11, 12, 13, 14, 15, 16; 41, 42, 43, 44, 45, 46) in frictional force-transmitting engagement with the plate cylinder (1), and drive means (147, 143, 145, 147; 152, 153, 155, 156) in engagement with the gear means (141, 151) driving the plate cylinders (1, 31), wherein the ink friction roller drive means driving said ink friction roller (41, 34) have a transmission ratio which drives the ink friction roller at a circumferential speed which is less than the circumferential speed of the plate cylinder (1);

the intermediate drive means driving said intermediate friction roller (6, 36) have a transmission ratio which drives the intermediate roller at the circumferential speed which is less than the circumferential speed of the plate cylinder (1) but higher than the circumferential speed of the ink friction roller (4, 34) so that the friction roller (4, 34) adjacent the ink supply has the lowest circumferential speed of said friction rollers to apply, by said friction rollers, a braking torque to the plate cylinder;

and wherein the friction roller (4, 34; 70, 80; 170, 180) of the serially arranged printing systems are driven by their respective drive means at such relative speeds that the ink friction rollers downstream in the direction of feed of material have a speed which is less than that of the respective ink friction rollers of the printing system next adjacent thereto and located upstream with respect thereto.

2. Printing press according to claim 1, wherein the drive motor forms a common drive means (174, 175) for said printing system, and the ink friction roller drive means (145, 142, 148, 144; 155, 152, 158, 154) comprises speed transmission means for connecting the common drive means to the driven ink friction rollers, said speed transmission means having a ratio of speed transmission to the driven ink friction rollers in which the braking or retardation torque applied by the rollers of the ink train to the plate cylinders is increasing in sequential printing systems of the serially arranged printing systems in the direction of feed of the material.

3. Printing press according to claim 1, wherein the motor forms a common drive means (174, 175) for said printing systems, and the friction roller drive means (145, 142, 148, 144; 155, 152, 158, 154) comprises speed transmission means for connecting the common drive means to the driven ink friction rollers, said speed transmission means having a ratio of speed transmission to the driven ink friction rollers in which the braking or retardation torque applied by the rollers of the ink train to the plate cylinders is increasing in sequential printing systems of the serially arranged printing systems as the distance of the sequential printing systems from the first printing system increases.

4. Printing press according to claim 1, wherein the motor forms a common drive means for said printing systems; and the friction roller drive means (145, 142, 148, 144; 156, 152, 158, 154) comprises speed transmission means for connecting the common drive means to the driven ink friction rollers, said speed transmission means having a ratio of speed transmission to the driven ink friction rollers in which the braking or retardation torque applied by the ink rollers of the ink train to the plate cylinders is increasing in sequential printing systems of the serially arranged printing systems as the distance from the drive motor (175) increases.

5. Printing press according to claim 1, wherein the ink friction roller drive means comprises variable speed transmission means (142, 142',148, 144; 143, 149, 146) connecting the drive motor to the ink friction rollers (4, 6).

6. Printing press according to claim 1, wherein the ink friction roller drive means comprises gear means driving the ink application rollers, the diameter of the ink friction roller being less than the diameter of the gear means driving the associated ink application roller.

7. Printing press according to claim 1, wherein the ink supply includes an ink ductor roller (94, 95) and the ink transfer and application rollers of the inking roller train include an ink film transfer roller (98, 99), and driven application rollers, wherein said drive means is in positive driving engagement with the transfer roller and drives the transfer roller at a circumferential speed of the ink film transfer roller (98, 99) of the ink train which is equal to or less than the circumferential speed of the next adjacent driven roller (102, 103) within the ink train.

8. Printing press according to claim 1, wherein the printing systems are double printing systems arranged to print on both sides of the material, wherein the speeds of the driven ink application rollers at both sides of the material have the same retardation with respect to the associated plate cylinders.

9. Printing press according to claim 1, wherein the drive motor forms a common drive means (174, 175) for said printing system, and the ink friction roller drive means (145, 142, 148, 144; 155, 152, 158, 154) comprises speed transmission means for connecting the comon drive means to the driven ink friction rollers, said speed transmission means having a ratio of speed transmission to the driven ink friction rollers in which the braking or retardation torque applied by the rollers of the ink train to the plate cylinders in any one printing system is essentially similar to that of any other printing system.

* * * * *

UNITED STATES PATENT AND TRADEMARK OFFICE

CERTIFICATE OF CORRECTION

PATENT NO. : 4,000,691

DATED : January 4, 1977

INVENTOR(S) : Hermann FISCHER

It is certified that error appears in the above-identified patent and that said Letters Patent are hereby corrected as shown below:

Line 30, of first page, please change to read -- February 28, 1973 Germany 2309850 --

Claim 9, line 6, (col. 10 line 51) correct "comon" to read -- common --

Signed and Sealed this

Fifth Day of April 1977

[SEAL]

*Attest:*

RUTH C. MASON
*Attesting Officer*

C. MARSHALL DANN
*Commissioner of Patents and Trademarks*